US009384957B2

(12) United States Patent
Yamaguchi

(10) Patent No.: US 9,384,957 B2
(45) Date of Patent: Jul. 5, 2016

(54) MASS ANALYSIS DEVICE AND MASS CALIBRATION METHOD

(71) Applicant: SHIMADZU CORPORATION, Kyoto-shi, Kyoto (JP)

(72) Inventor: Shinichi Yamaguchi, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 0 days.

(21) Appl. No.: 14/441,579

(22) PCT Filed: Nov. 9, 2012

(86) PCT No.: PCT/JP2012/079168
§ 371 (c)(1),
(2) Date: May 8, 2015

(87) PCT Pub. No.: WO2014/073094
PCT Pub. Date: May 15, 2014

(65) Prior Publication Data

US 2015/0279649 A1 Oct. 1, 2015

(51) Int. Cl.
*H01J 49/26* (2006.01)
*H01J 49/02* (2006.01)

(52) U.S. Cl.
CPC ..... *H01J 49/26* (2013.01); *H01J 49/025* (2013.01)

(58) Field of Classification Search
USPC ..... 250/281, 282, 283, 288; 702/19, 22, 23, 702/24, 25, 26, 27, 28
See application file for complete search history.

(56) References Cited

U.S. PATENT DOCUMENTS

| | | | | |
|---|---|---|---|---|
| 7,071,463 | B2 | 7/2006 | Bowdler | |
| 2005/0151073 | A1 | 7/2005 | Kato | |
| 2005/0253060 | A1 | 11/2005 | Mimura et al. | |
| 2007/0136017 | A1 * | 6/2007 | Wang et al. | 702/85 |
| 2008/0067346 | A1 * | 3/2008 | Amster et al. | 250/282 |

(Continued)

FOREIGN PATENT DOCUMENTS

| | | | |
|---|---|---|---|
| EP | 2 136 389 | A1 | 12/2009 |
| JP | 2005-181236 | A | 7/2005 |

(Continued)

OTHER PUBLICATIONS

Extended European Search Report issued Sep. 9, 2015 in corresponding European Patent Application No. 12887871.7.

(Continued)

*Primary Examiner* — Nicole Ippolito
(74) *Attorney, Agent, or Firm* — Sughrue Mion, PLLC

(57) ABSTRACT

In conducting multiple repetitions of MS/MS analysis on the same test sample for which a precursor ion whose m/z is known (m/z=M) has been established, MS/MS analysis is conducted under a dissociation condition in which CID is less prone to occur in part of the analysis. When an MS/MS spectrum is created by summing up spectral data thus obtained, a known precursor ion is observed at m/z=M without exception. Thus, a peak corresponding to the precursor ion is detected on the MS/MS spectrum, a mass deviation between an actual measured value and theoretical value M of m/z at the peak is determined, and a spectrum is created by correcting other peaks for mass shifts based on the mass deviation. This makes it possible to mass-calibrate the MS/MS spectrum in substantially the same manner as an internal standard method and improve mass accuracy over conventional methods.

4 Claims, 5 Drawing Sheets

(56) References Cited

U.S. PATENT DOCUMENTS

| | | | | |
|---|---|---|---|---|
| 2010/0065740 | A1 | 3/2010 | Iwamoto et al. | |
| 2014/0138526 | A1* | 5/2014 | Goldberg | 250/252.1 |
| 2015/0073727 | A1* | 3/2015 | Zubarev et al. | 702/23 |

FOREIGN PATENT DOCUMENTS

| | | | |
|---|---|---|---|
| JP | 2005-292093 | A | 10/2005 |
| JP | 4894918 | B2 | 3/2012 |
| WO | 2008/129850 | A1 | 10/2008 |

OTHER PUBLICATIONS

Karine Clauwaert, et al., "Exact mass measurement of product ions for the structural confirmation and identification of unknown compounds using a quadrupole time-of-flight spectrometer: a simplified approach using combined tandem mass spectrometric functions", Rapid Communications In Mass Spectrometry, RCM, May 22, 2003, pp. 1443-1448, vol. 17.

International Search Report of PCT/JP2012/079168, dated Feb. 12, 2013. [PCT/ISA/210].

* cited by examiner

Fig. 3A MS SPECTRUM
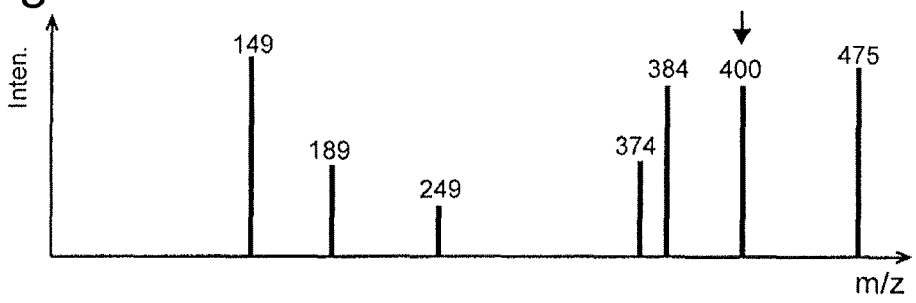
Fig. 3B MS/MS SPECTRUM (PRECURSOR ION HAS DISAPPEARED)
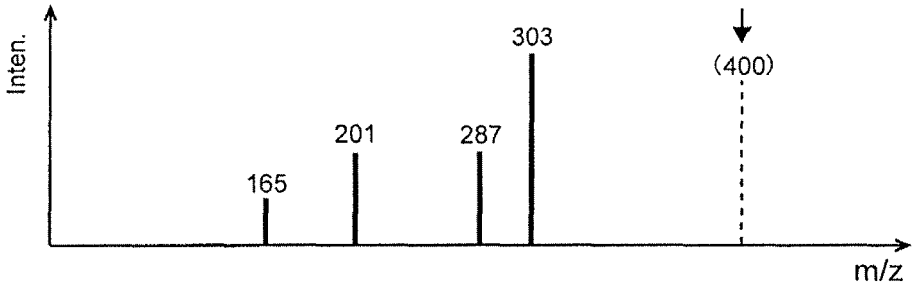
Fig. 3C MS/MS SPECTRUM (PRECURSOR ION REMAINS)
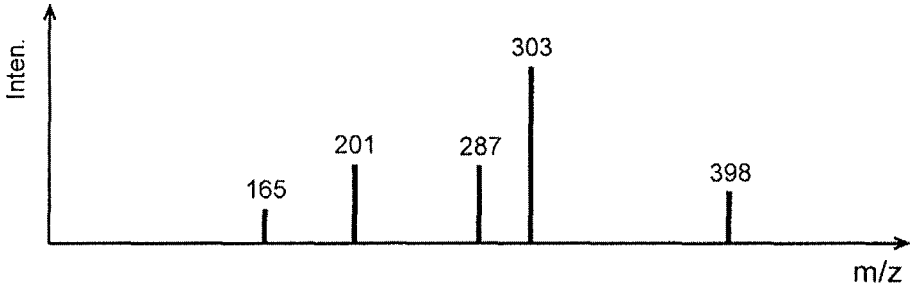
Fig. 3D MS/MS SPECTRUM AFTER MASS CALIBRATION
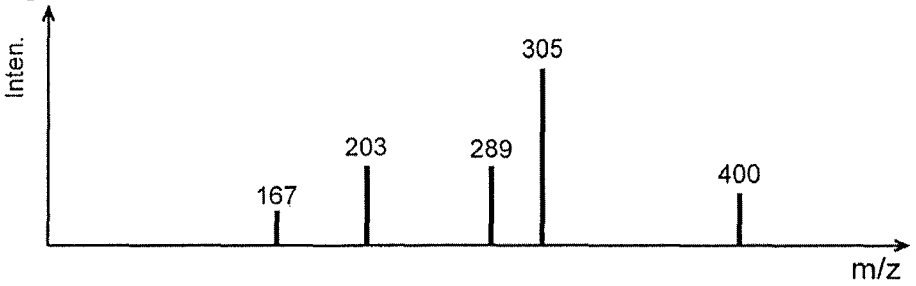

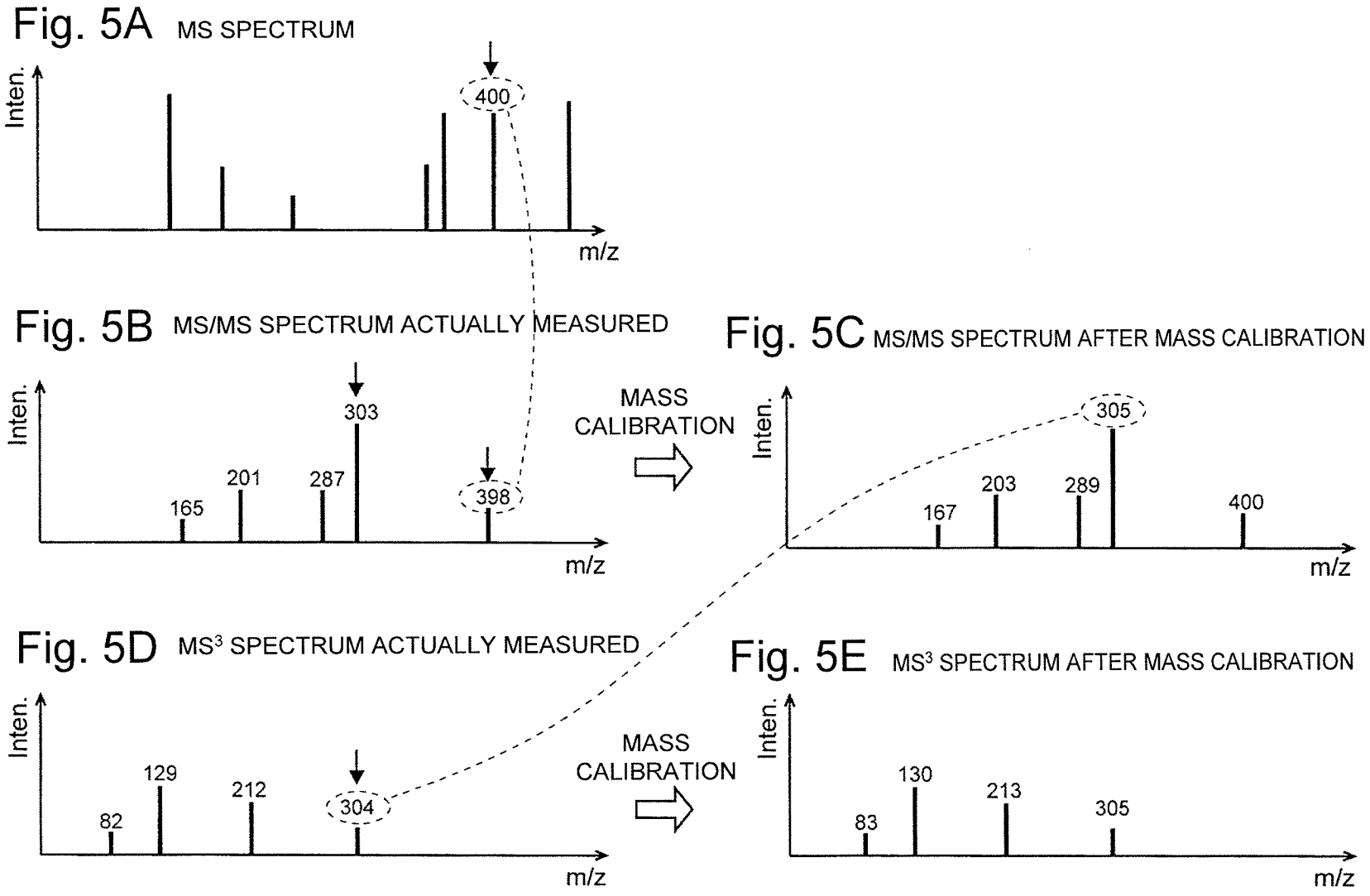
Fig. 5A MS SPECTRUM
Intens.
m/z
400
Fig. 5B MS/MS SPECTRUM ACTUALLY MEASURED
Intens.
m/z
303
287
201
165
398
MASS CALIBRATION
Fig. 5C MS/MS SPECTRUM AFTER MASS CALIBRATION
Intens.
m/z
305
289
203
167
400
Fig. 5D MS³ SPECTRUM ACTUALLY MEASURED
Intens.
m/z
129
212
82
304
MASS CALIBRATION
Fig. 5E MS³ SPECTRUM AFTER MASS CALIBRATION
Intens.
m/z
130
213
83
305

MASS ANALYSIS DEVICE AND MASS CALIBRATION METHOD

CROSS REFERENCE TO RELATED APPLICATIONS

This application is a National Stage of International Application No. PCT/JP2012/079168 filed Nov. 9, 2012, the contents of all of which are incorporated herein by reference in their entirety.

TECHNICAL FIELD

The present invention relates to a mass spectrometer capable of $MS^n$ (where n is an integer equal to or larger than 2) analysis as well as to a mass calibration method for the mass spectrometer.

BACKGROUND ART

Mass spectrometers can measure mass-to-charge ratios m/z of ions originating from a compound, where the value of mass-to-charge ratios fluctuate due to various factors. The width of fluctuation of the measured values of mass-to-charge ratio is regarded as the mass accuracy of a given mass spectrometer. To enhance the mass accuracy, a mass calibration is normally performed for the mass spectrometer using measurement results of a compound whose theoretical value (or highly accurate measurement value) of the mass-to-charge ratio is known.

For example, apparatuses described in Patent Literature 1 and the like measure a standard sample containing a certain compound whose theoretical value of mass-to-charge ratio is known, compare an actual measured value and the theoretical value of the mass-to-charge ratio, and thereby determine a mass deviation at the mass-to-charge ratio. Then, based on mass deviations obtained at different mass-to-charge ratios of plural compounds, a calibration curve which represents a relationship between the mass-to-charge ratio and mass deviation is created. Based on the calibration curve thus created, the actual measured value of the mass-to-charge ratio obtained by measuring any compound in a target sample is calibrated. Such mass calibration allows the mass-to-charge ratio of a desired compound to be determined at high accuracy.

The mass calibration method described above measures the standard sample and target sample separately, and consequently it is not possible to eliminate mass deviations caused by differences in measurement conditions, environmental conditions, and the like used for measurements of the two samples. Another type of mass calibration is also performed using an internal standard method, when a peak originating from a known compound whose theoretical value of mass-to-charge ratio is known exists in a mass spectrum obtained by measuring a target sample. In the internal standard method, a mass deviation is determined using the actual measured value and theoretical value of the mass-to-charge ratio at the peak, and corrects the mass-to-charge ratios at other peaks in the mass spectrum based on the mass deviation. This mass calibration method performs mass calibration based on the results of measurement performed at a time, and thus the mass calibration is made at higher accuracy.

However, mass calibration of the internal standard method described above can be made only when a peak originating from a known compound exists in an acquired mass spectrum and can be detected.

In $MS^n$ spectra obtained by an ion trap time-of-flight mass spectrometer or by a tandem quadrupole mass spectrometer, various product ions produced by dissociation of a single compound selected based on a mass-to-charge ratio are observed, but, other than these product ions, an ion peak of a compound whose accurate mass-to-charge ratio is known does not exist in many cases. In such cases, mass calibration by the internal standard method described above cannot be used. Thus, conventionally it is common practice to perform mass calibration of the peaks of an $MS^n$ spectrum using mass deviation values or a mass calibration table obtained by the internal standard method on the $MS^1$ spectrum (mass spectrum) obtained from the same sample without a dissociation operation (see Patent Literature 2 and the like). Consequently, it is unavoidable that the mass accuracy of an $MS^n$ spectrum is inferior to the mass accuracy of the $MS^1$ spectrum.

CITATION LIST

Patent Literature

[Patent Literature 1] JP 2005-292093 A
[Patent Literature 2] U.S. Pat. No. 7,071,463 A

SUMMARY OF INVENTION

Technical Problem

The present invention is accomplished to solve the aforementioned problem and has an object to provide a mass spectrometer and mass calibration method which can obtain an $MS^n$ spectrum higher in mass accuracy than conventional ones by improving the accuracy of the mass calibration of the $MS^n$ spectrum.

Solution to Problem

A first specific form of a mass spectrometer according to the present invention accomplished to solve the aforementioned problem is provided with an ion dissociator for dissociating ions originating from a compound in a sample and a mass analyzer for performing mass analysis on ions generated by an ion dissociation operation of the ion dissociator, and is configured to be able to perform $MS^n$ (where n is an integer equal to or larger than 2) analysis, the mass spectrometer including:

a) an analysis controller for causing the ion dissociator to perform a dissociation operation with a dissociation condition adjusted such that a peak corresponding to a known mass-to-charge ratio and observed in an $MS^1$ spectrum obtained without performing an ion dissociation operation remains in an $MS^n$ spectrum;

b) a spectrum creator for creating the $MS^n$ spectrum based on spectral data obtained when the dissociation operation is performed by the ion dissociator under control of the analysis controller; and c) a mass calibration processing unit for detecting the peak corresponding to the known mass-to-charge ratio in the $MS^n$ spectrum created by the spectrum creator and calibrating mass-to-charge ratios at respective peaks in the $MS^n$ spectrum using a difference between an actual measured value and a known value of the mass-to-charge ratio at the peak.

A first specific form of a mass calibration method according to the present invention accomplished to solve the aforementioned problem is a mass calibration method for a mass spectrometer adapted to dissociate ions originating from a compound in a sample and analyze ions generated by an ion dissociation operation and configured to be able to perform $MS^n$ (where n is an integer equal to or larger than 2) analysis, the mass calibration method including:

a spectrum creation step of performing a dissociation operation with a dissociation condition adjusted such that a peak corresponding to a known mass-to-charge ratio and observed in an $MS^1$ spectrum obtained without performing an ion dissociation operation remains in an $MS^n$ spectrum and creating the $MS^n$ spectrum based on spectral data thus obtained;

a mass calibration step of detecting the peak corresponding to the known mass-to-charge ratio in the $MS^n$ spectrum created in the spectrum creation step and calibrating mass-to-charge ratios at respective peaks in the $MS^n$ spectrum using a difference between an actual measured value and a known value of the mass-to-charge ratio at the peak.

In the first specific form of the mass spectrometer and the mass calibration method according to the present invention, the peak corresponding to the known mass-to-charge ratio may be, for example, a peak of a precursor ion for $MS^n$ analysis or a peak of an isotopic ion which has the same composition of elements as the precursor ion and contains an element other than a stable isotope. Note that the "known mass-to-charge ratio" as referred to herein may be not only a theoretical value of a mass-to-charge ratio determined by calculation from the composition of elements of the compound, but also a precise measured value obtained through actual measurements by a mass spectrometer with a sufficiently high accuracy or another apparatus.

In this case, preferably the spectrum creator creates the $MS^n$ spectrum by summing up spectral data obtained through a plurality of $MS^n$ analysis runs; and in at least one of a plurality of $MS^n$ analysis runs on a same sample, the analysis controller performs a mass analysis without dissociating precursor ions or performs a mass analysis involving a dissociation operation in which the dissociating energy given to a precursor ion is lowered to such a level that the precursor ion is assumed to remain adequately in the $MS^n$ spectrum.

In a mass spectrometer such as an ion trap mass spectrometer or a triple quadrupole mass spectrometer, as a technique for dissociating ions, collision induced dissociation (CID) is often used. In the collision induced dissociation, to make a peak originating from precursor ions remain in the $MS^n$ spectrum, it is possible to change dissociation conditions to reduce collision energy given to ions during a dissociation operation or to lower gas pressure of collision induced dissociation gas. The latter is unsuitable for rapid changes, but allows easy control because the collision energy can be changed by simply changing the voltage applied to an electrode. Otherwise, when ions are dissociated in an ion trap, precursor ions can be made to remain adequately in the $MS^n$ spectrum by reducing the dissociation time.

Since a peak corresponding to a known mass-to-charge ratio is supposed be observed in the $MS^n$ spectrum which is based on the data obtained by a characteristic $MS^n$ analysis such as described above, the mass calibration processing unit detects the peak and calibrates the mass-to-charge ratios at respective peaks in the $MS^n$ spectrum using the mass deviation between an actual measured value and a known value of the mass-to-charge ratio at the peak. When multiple runs of $MS^n$ analysis are conducted on the same sample by changing the dissociation conditions, spectral data obtained almost at the same time, although not strictly the same time, are reflected in one $MS^n$ spectrum. Therefore, the mass deviation obtained based on the $MS^n$ spectrum is substantially equivalent to the mass deviation obtained by the internal standard method, and this allows mass calibration of the $MS^n$ spectrum to be performed with higher accuracy than before.

Also, a second specific form of the mass spectrometer according to the present invention accomplished to solve the aforementioned problem is provided with an ion dissociator for dissociating ions originating from a compound in a sample and a mass analyzer for performing mass analysis on ions generated by an ion dissociation operation of the ion dissociator and is configured to be able to perform $MS^n$ (where n is an integer equal to or larger than 2) analysis, the mass spectrometer including:

a) an ion adder for adding an ion whose mass-to-charge ratio is known to ions generated by the ion dissociation operation of the ion dissociator, before the mass analyzer performs a mass analysis on the generated ions;

b) a spectrum creator for creating an $MS^n$ spectrum based on spectral data obtained when ions are added by the ion adder; and c) a mass calibration processing unit for detecting a peak corresponding to the ion whose mass-to-charge ratio is known in the $MS^n$ spectrum created by the spectrum creator and calibrating mass-to-charge ratios at respective peaks in the $MS^n$ spectrum using a difference between an actual measured value and a known value of the mass-to-charge peak ratio.

The ion adder according to the second specific form may include an ion trap for holding ions, for example, by dissociating the ions in the ion trap or for holding ions dissociated externally; and a controller for driving and controlling the ion trap such that an ion whose mass-to-charge ratio is known will be additionally introduced into the ion trap from outside in a state in which various product ions generated by dissociation are held in the ion trap and will be held together with ions held originally. Such addition of an ion is performed immediately after an $MS^n$ analysis, followed by a mass analysis performed by the mass analyzer, and thus the mass deviation obtained based on the $MS^n$ spectrum is substantially equivalent to the mass deviation obtained by the internal standard method. Consequently, as with the first specific form, the second specific form allows mass calibration of the $MS^n$ spectrum to be performed with higher accuracy than before.

Also, a third specific form of the mass spectrometer according to the present invention accomplished to solve the aforementioned problem is provided with an ion dissociator for dissociating ions originating from a compound in a sample and a mass analyzer for performing mass analysis on ions generated by an ion dissociation operation of the ion dissociator and is configured to be able to perform $MS^n$ (where n is an integer equal to or larger than 2) analysis, the mass spectrometer including:

a) an analysis controller for causing the ion dissociator and the mass analyzer to perform a mass analysis on an ion having a known mass-to-charge ratio immediately before or immediately after an $MS^n$ analysis on a test sample without performing a dissociation operation;

b) a spectrum creator for creating an $MS^n$ spectrum by combining spectral data obtained by the $MS^n$ analysis on the test sample and spectral data obtained by the mass analysis on the ions having the known mass-to-charge ratio under control of the analysis controller; and c) a mass calibration processing unit for detecting the peak corresponding to the known mass-to-charge ratio in the $MS^n$ spectrum created by the spectrum creator and calibrating mass-to-charge ratios at respective peaks in the $MS^n$ spectrum using a difference between an actual measured value and a known value of the mass-to-charge ratio at the peak.

That is, whereas in the first specific form, an $MS^n$ analysis is conducted with a dissociation condition adjusted in such a way as to intentionally leave a precursor ion or the like whose mass-to-charge ratio is known, but in the third specific form, for example, only a precursor ion selection is performed, a mass analysis is performed immediately before or immediately after an $MS^n$ analysis (or in the course of the $MS^n$ analysis if the $MS^n$ analysis is run multiple times) by omitting a dissociation operation which normally follows the $MS^n$ analysis, and the results of the $MS^n$ analysis are reflected in the $MS^n$ spectrum. Thus, as with the first specific form, in the third specific form, an ion peak whose mass-to-charge ratio is known appears clearly in the $MS^n$ spectrum allowing mass calibration of the $MS^n$ spectrum to be performed with higher accuracy than before by using the mass deviation based on the peak.

In the case of $MS^n$ analysis in which n is 3 or above, i.e., when two or more steps of dissociation operation are carried out, even if the dissociation condition is changed as in the case of the first specific form, it is difficult to leave the original precursor ion with sufficient intensity in the $MS^n$ spectrum. This becomes more pronounced with increases in the number of dissociation steps. Thus, product ions subjected to highly accurate mass calibration in an $MS^2$ spectrum using a technique such as the technique of the first specific form can be left as precursor ions for an $MS^3$ spectrum in an $MS^3$ analysis and a difference between an actual measured value of the mass-to-charge ratio of the precursor ion and a mass-calibrated highly accurate mass-to-charge ratio value can be set as a mass deviation and this operation can be performed stepwise with increases in n.

That is, a fourth specific form of the mass spectrometer according to the present invention accomplished to solve the aforementioned problem is provided with an ion dissociator for dissociating ions originating from a compound in a sample into n−1 steps and a mass analyzer for performing mass analysis on ions generated by an ion dissociation operation of the ion dissociator and is configured to be able to perform $MS^n$ (where n is an integer equal to or larger than 3) analysis, the mass spectrometer including:

a) an analysis controller for causing the ion dissociator to perform a dissociation operation with a dissociation condition adjusted such that a precursor ion for the (m−1)th step of the dissociation operation remains in an $MS^m$ spectrum during an $MS^m$ analysis (where m is 2, 3, . . . , n);

b) a spectrum creator for creating an $MS^m$ spectrum based on spectral data obtained when the dissociation operation is performed by the ion dissociator under control of the analysis controller; and c) a mass calibration processing unit for detecting a peak of a precursor ion having a known mass-to-charge ratio in an $MS^2$ spectrum created by the spectrum creator and calibrating mass-to-charge ratios at respective peaks in the $MS^2$ spectrum using a difference between an actual measured value and a known value of the mass-to-charge ratio at the peak when m is 2 or detecting a peak of a precursor ion or a product ion whose mass-to-charge ratio has been calibrated, in an $MS^m$ spectrum created by the spectrum creator and calibrating mass-to-charge ratios at respective peaks in the $MS^m$ spectrum using a difference between an actual measured value of the mass-to-charge ratio at the peak and a calibrated value of the mass-to-charge ratio when m is between 3 and n−1 both inclusive.

This configuration allows mass calibration of the $MS^n$ spectrum to be performed with high accuracy when an $MS^n$ analysis in which n is 3 or above is performed, but when the second specific form and third specific form cannot be adopted.

Advantageous Effects of Invention

The mass spectrometer and mass calibration method according to the present invention allows mass calibration to be performed using a technique equivalent to or close to an internal standard method in acquiring an $MS^n$ spectrum and thereby makes it possible to obtain the $MS^n$ spectrum with high mass accuracy using high accuracy mass calibration.

BRIEF DESCRIPTION OF DRAWINGS

FIG. 3A, FIG. 3B, FIG. 3C, and FIG. 3D are spectrum diagrams for explaining a mass calibration technique for an MS/MS spectrum on the mass spectrometer according to the first embodiment.

FIG. 5A, FIG. 5B, FIG. 5C, FIG. 5D and FIG. 5E are spectrum diagrams for explaining a mass calibration technique for an $MS^3$ spectrum on a mass spectrometer according to a third embodiment.

DESCRIPTION OF EMBODIMENTS

Embodiments of a mass spectrometer for performing a mass calibration method according to the present invention will be described below with reference to the accompanying drawings.

First Embodiment

Figure 1:
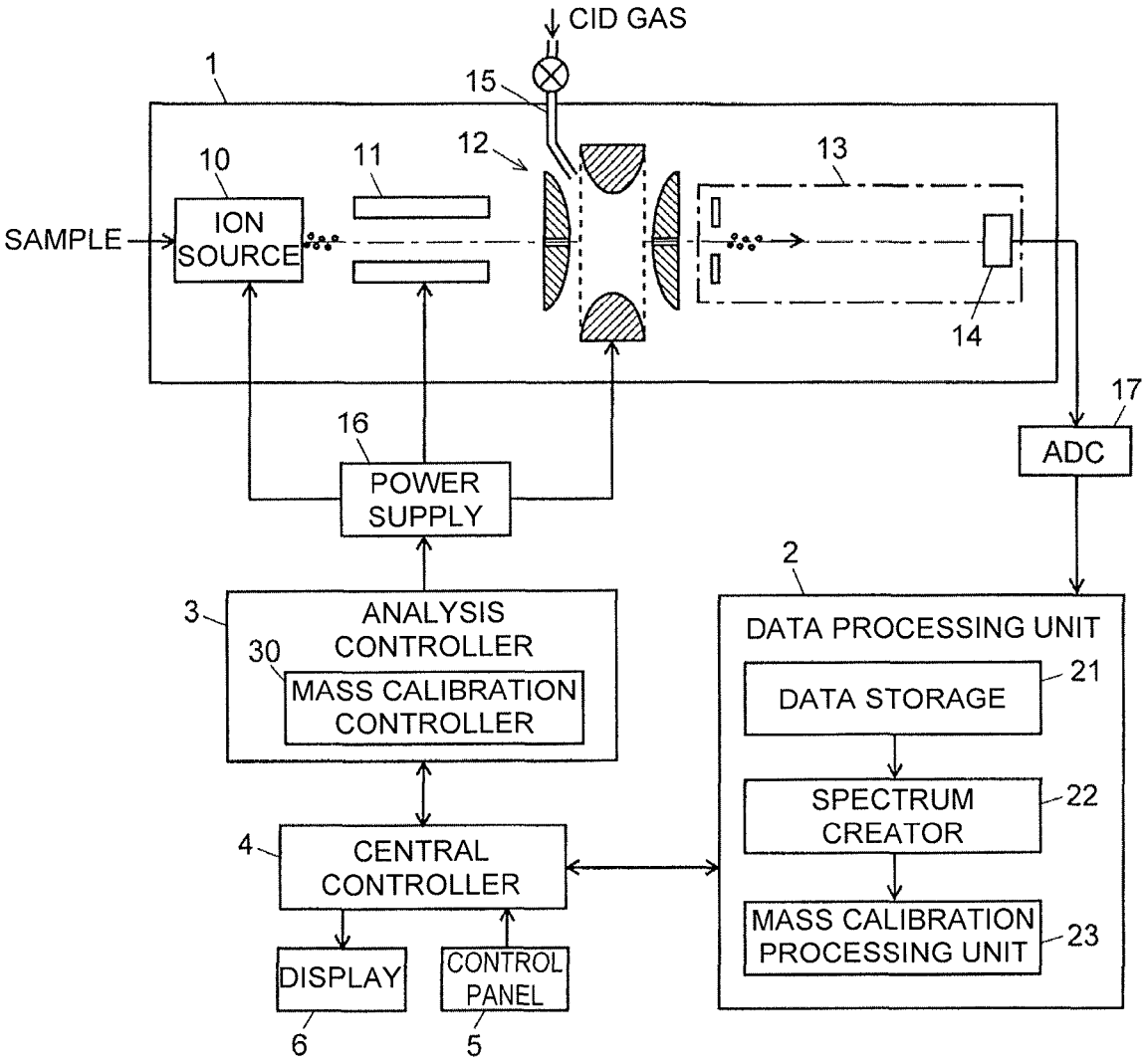
FIG. 1 is a schematic configuration diagram of a first embodiment of a mass spectrometer for performing a mass calibration method according to the present invention.

FIG. 1 is a schematic configuration diagram of a mass spectrometer according to a first embodiment.

An analyzer 1 of the present apparatus includes an ion source 10, an ion transport optical system 11 such as an ion guide, a three-dimensional quadrupole ion trap 12, a time-of-flight mass spectrograph (TOF) 13, and an ion detector 14, where a CID gas such as argon is supplied into the ion trap 12 through a gas supply pipe 15, in the middle of which a valve is provided. As the ion source 10, any of various types of ion source can be used as appropriate according to the form of the sample to be measured, the types of ion source including a matrix-assisted laser desorption/ionization (MALDI) type, an atmospheric pressure chemical ionization type such as an electrospray ionization (ESI) type, and an electron ionization type. A power supply 16 applies necessary voltages to various components under the control of an analysis controller 3 to perform MS analysis, MS/MS(=$MS^2$) analysis, and the like described later.

A detection signal of the ion detector 14 is converted into digital data by an analog-to-digital converter (ADC) 17 and inputted to a data processing unit 2. The data processing unit 2 includes a data storage 21, a spectrum creator 22, a mass calibration processing unit 23, and the like as functional blocks characteristic of the present invention. The analysis controller 3 controls power supply 16 as well as controls opening and closing of a valve on a gas supply pipe 15, and so on. The analysis controller 3 includes a mass calibration controller 30 as a functional block characteristic of the present invention. A central controller 4 exerts overall control over the entire apparatus and serves as a user interface and is connected with a control panel 5 and a display 6. Part of the central controller 4, data processing unit 2, and analysis controller 3 may be configured to be implemented when a dedicated processing/control program installed on a personal computer used as a hardware resource is executed.

With the mass spectrometer according to the present embodiment, various ions generated by the ion source 10 and originating from a sample are temporarily captured in the ion trap 12, ions (precursor ions) having a specific mass-to-charge ratio are selected in the ion trap 12 and dissociated by CID, and product ions produced as a result of the dissociation are mass analyzed by the TOF 13, thereby making it possible to acquire MS/MS spectral data. Of course, if precursor ion selection and dissociation operation are repeated twice or more in the ion trap 12, an $MS^n$ analysis in which n is 3 or above can be performed as well. The mass spectrometer according to the present embodiment performs characteristic analysis operation and data processing operation in order to perform mass calibration of an $MS^n$ spectrum obtained by an $MS^n$ analysis (where n is an integer equal to or larger than 2) including an MS/MS analysis.

Figure 2:
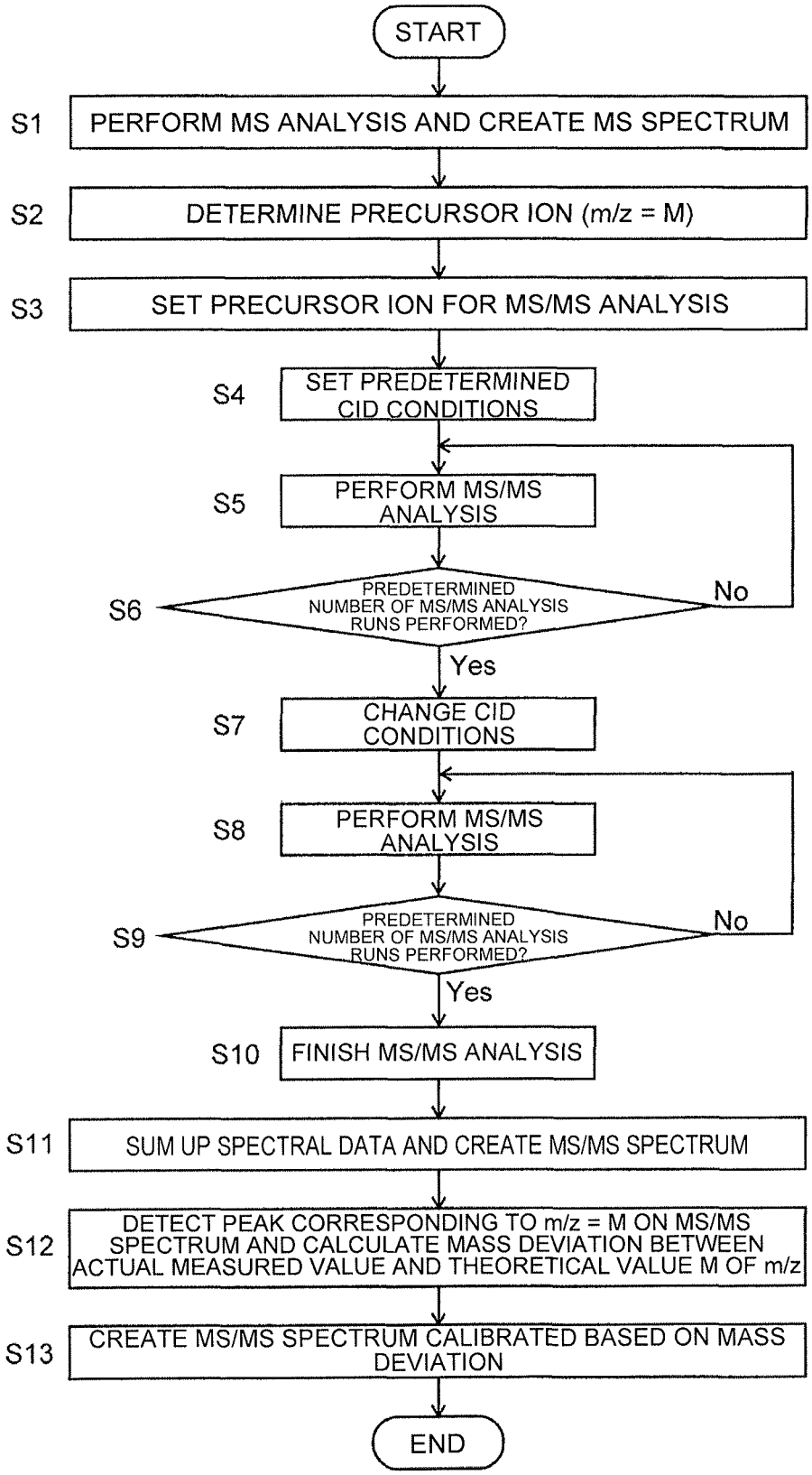
FIG. 2 is a flowchart of analysis operation and processing operation for acquiring an MS/MS spectrum mass-calibrated by the mass spectrometer according to the first embodiment.

Mass calibration operation performed by the mass spectrometer according to the present embodiment will be described in detail below with reference to FIG. 2, FIG. 3A, FIG. 3B, and FIG. 3C. FIG. 2 is a flowchart illustrating an example of analysis operation and processing operation for acquiring a mass-calibrated MS/MS spectrum while FIG. 3A, FIG. 3B, FIG. 3C and FIG. 3D are diagrams illustrating examples of spectrums for explaining a mass calibration technique for an MS/MS spectrum.

Under the control of the analysis controller 3, the analyzer 1 performs normal mass analysis ($MS^1$ analysis) without involving a precursor ion selection or CID operation with respect to a test sample and the spectrum creator 22 creates an $MS^1$ spectrum based on the spectral data obtained by the $MS^1$ analysis (Step S1).

That is, a compound in a test sample is ionized by the ion source 10, various ions generated are converged and introduced into the ion trap 12 by the ion transport optical system 11. In so doing, no CID gas is introduced into the ion trap 12 and no precursor ion selection or CID operation is performed. Various ions temporarily captured in the ion trap 12 are cooled and then ejected from the ion trap 12 almost all at once and sent into a flight space of the TOF 13. While flying in the flight space, the various ions are separated according to their respective mass-to-charge ratios and then enter the ion detector 14 with time lags. The ion detector 14 obtains a detection signal which represents the amount of arriving ions changing with the passage of time starting from the time of ion ejection from the ion trap 12. Through A/D conversion, the detection signal is converted into spectral data which represents a relationship between the flight time and signal intensity of each ion.

The spectrum creator 22 converts the flight time into the mass-to-charge ratio, thereby creates an $MS^1$ spectrum which represents the relationship between the flight time and signal intensity, and displays the $MS^1$ spectrum on a screen of the display 6 via the central controller 4. FIG. 3A is an example of the $MS^1$ spectrum obtained at this time. An analyst confirms the $MS^1$ spectrum on the screen and determines an ion which is an object to be analyzed and whose mass-to-charge ratio is known highly accurately, as a precursor ion (Step S2). It is assumed here that the known mass-to-charge ratio of the precursor ion is m/z=M.

Next, an MS/MS analysis with the aforementioned precursor ion established is conducted on the same test sample, and in so doing, such a characteristic analysis that will enable high-accuracy mass calibration is conducted (Step S3). Specifically, MS/MS analysis is repeated multiple times on the same test sample with the same precursor ion established, and in this process, CID conditions for the ion trap 12 are changed according to predetermined procedures. With the configuration of the mass spectrometer according to the present embodiment, the CID conditions include excitation energy (actually, values of voltages applied to a ring electrode and endcap electrode of the ion trap 12 and frequencies of the voltages) used to excite ions in order to dissociate the ions, dissociation time, and CID gas pressure, and in this case, with the dissociation time and CID gas pressure kept constant, the CID conditions are changed by switching the excitation energy to plural predetermined values in sequence.

Generally, in MS/MS analysis, in order to detect product ions with high sensitivity, the CID condition (excitation energy) is determined so as to achieve high CID efficiency. Normally, when a CID operation is performed under such a CID condition, almost all precursor ions are dissociated, leaving few precursor ions. In contrast, MS/MS analysis is conducted, in which the excitation energy is lowered to such a level that precursor ions are assumed to remain with sufficient intensity even after a CID operation in one or about 10% to 30% of multiple MS/MS analysis runs on the same test sample, and the other MS/MS analysis runs are conducted as usual at such excitation energy that will provide good CID efficiency.

In order to conduct MS/MS analysis in such a way as described above, the mass calibration controller 30 first sets the dissociation time and CID gas pressure to predetermined values, sets the excitation energy at the highest of plural predetermined levels, i.e., at such a level that will provide good CID efficiency (Step S4), and conducts the MS/MS analysis (Step S5). In the MS/MS analysis, as with the $MS^1$ analysis, the compound in the test sample is ionized by the ion source 10 and various ions generated are introduced into the ion trap 12. After the various ions are temporarily captured in the ion trap 12, an ion selection operation is performed so as to leave only specified precursor ions in the ion trap 12 and discharge the other ions from the ion trap 12. Subsequently, the remaining precursor ions are excited and facilitated to come into contact with CID gas and thereby dissociated. The product ions produced as a result of the dissociation are captured in the ion trap 12 and cleaned by a CID operation performed for a predetermined period of time, and then the captured ions are ejected from the ion trap 12 almost all at once and sent into a flight space of the TOF 13. As with the $MS^1$ analysis, the various ions are separated in the TOF 13 according to their mass-to-charge ratios and the ion detector 14 outputs a detection signal. The spectral data obtained through A/D conversion of the detection signal is temporarily stored in the data storage 21. At this time, since the CID efficiency is good, the resulting spectral data contains almost no information about the original precursor ions.

Under the control of the mass calibration controller 30, the MS/MS analysis is conducted on the same test sample through repetitions of S4→S5→S6→S5→ . . . , and when a predetermined number of repetitions is reached (Yes in Step S6), the mass calibration controller 30 changes the CID conditions, as described above, so as to lower the excitation energy to such a level that the precursor ion is assumed to remain adequately in the $MS^n$ spectrum (Step S7) and then conducts the MS/MS analysis (Step S8). As the excitation energy decreases, CID becomes less prone to occur and the resulting spectral data contains information about the original precursor ion. The MS/MS analysis is repeated, in which the excitation energy is lowered until a Yes determination is made in Step S9, and then the MS/MS analysis is finished (Step S10).

When the MS/MS analysis is finished, in the data processing unit 2, the spectrum creator 22 reads all the spectral data obtained as a result of the MS/MS analysis out of the data storage 21, converts time into the mass-to-charge ratio, sums up signal intensity values for each mass-to-charge ratio, and thereby creates an MS/MS spectrum (Step S11). Since CID conditions have been changed in multiple runs of MS/MS analysis as described above, spectral data in which the precursor ion is observed with sufficient intensity is contained in the MS/MS spectrum. Therefore, in the MS/MS spectrum created by summing up data, not only a peak of product ions produced by dissociation of the precursor ion whose mass-to-charge ratio m/z is M, but also a peak of the precursor ion itself appears.

FIG. 3C is an example of an MS/MS spectrum obtained in this way. Also, FIG. 3B is an example of an MS/MS spectrum obtained by conducting MS/MS analysis under such CID conditions which will provide sufficiently high CID efficiency without reducing excitation energy. In FIG. 3B, as indicated by a dotted line, the precursor ion which has M=400 is not observed, and product ions are observed with high sensitivity instead. On the other hand, in FIG. 3C, although the peak intensity of each product ion decreases slightly, the precursor ion is observed with sufficient intensity. This is a result of intentionally decreasing the excitation energy.

The mass calibration processing unit 23 detects a peak corresponding to the precursor ion (m/z=M) on the MS/MS spectrum. This can be done, for example, by setting a predetermined width Δ for an accurate mass-to-charge ratio M of the precursor ion to establish a detection window M±Δ and determining any peak which exists in the detection window and has an intensity equal to or larger than a predetermined threshold as being a precursor ion peak. Then, if a peak corresponding to the precursor ion is detected, mass-to-charge ratio value (actual measured value) M' of the peak is determined and the mass deviation ΔM=M−M' between the actual measured value M' and accurate value M is calculated (Step S12). The mass deviation ΔM is the mass shift in MS/MS analysis. Next, the mass calibration processing unit 23 corrects the position (mass-to-charge ratio) of each peak on the MS/MS spectrum created in step S10, according to the mass deviation ΔM and thereby creates a mass-calibrated MS/MS spectrum (Step S13).

In the example of FIG. 3, since the mass deviation is ΔM=400−398=2, by shifting the mass-to-charge ratio of each peak on the MS/MS spectrum of FIG. 3C to the higher side of the mass-to-charge ratio by 2 Da, the MS/MS spectrum shown in FIG. 3D is created. Of course, instead of shifting each peak on the MS/MS spectrum, the time axis may be shifted in the opposite direction.

For the mass spectrometer according to the first embodiment, mass calibration of an MS/MS spectrum equivalently to the internal standard method can be performed in this way, and thus mass calibration is made at higher accuracy than before.

Although in the first embodiment, the excitation energy is decreased during MS/MS analysis to intentionally leave precursor ions, the dissociation time may be reduced alternatively. The CID efficiency may be reduced by reducing the CID gas pressure, but even if CID gas supply is reduced, the CID gas pressure does not stabilize quickly at a low level, and thus it is practically difficult to stably change the CID condition using the CID gas pressure.

Also, when conducting multiple runs of MS/MS analysis on the same test sample as described above, MS/MS analysis may be conducted at least once without performing a CID operation after selecting a precursor ion in the ion trap 12 (although the analysis is not MS/MS analysis in a strict sense because no CID operation is performed, the analysis is referred to as MS/MS analysis for convenience' sake because a precursor ion is selected). In this case, the precursor ion certainly remains in the MS/MS spectrum with sufficient intensity. However, the intensity of product ions is reduced accordingly.

Also, rather than from the precursor ion itself originating from a target compound, the mass deviation may be determined on the MS/MS spectrum by detecting an ion which has the same composition of elements as the target compound, contains an isotopic element other than a stable isotope, and has a mass-to-charge ratio differing from that of the precursor ion by predetermined mass and comparing an actual measured value and theoretical value (or a highly accurate measured value) of the mass-to-charge ratio at the peak of the ion.

Second Embodiment

Figure 4:
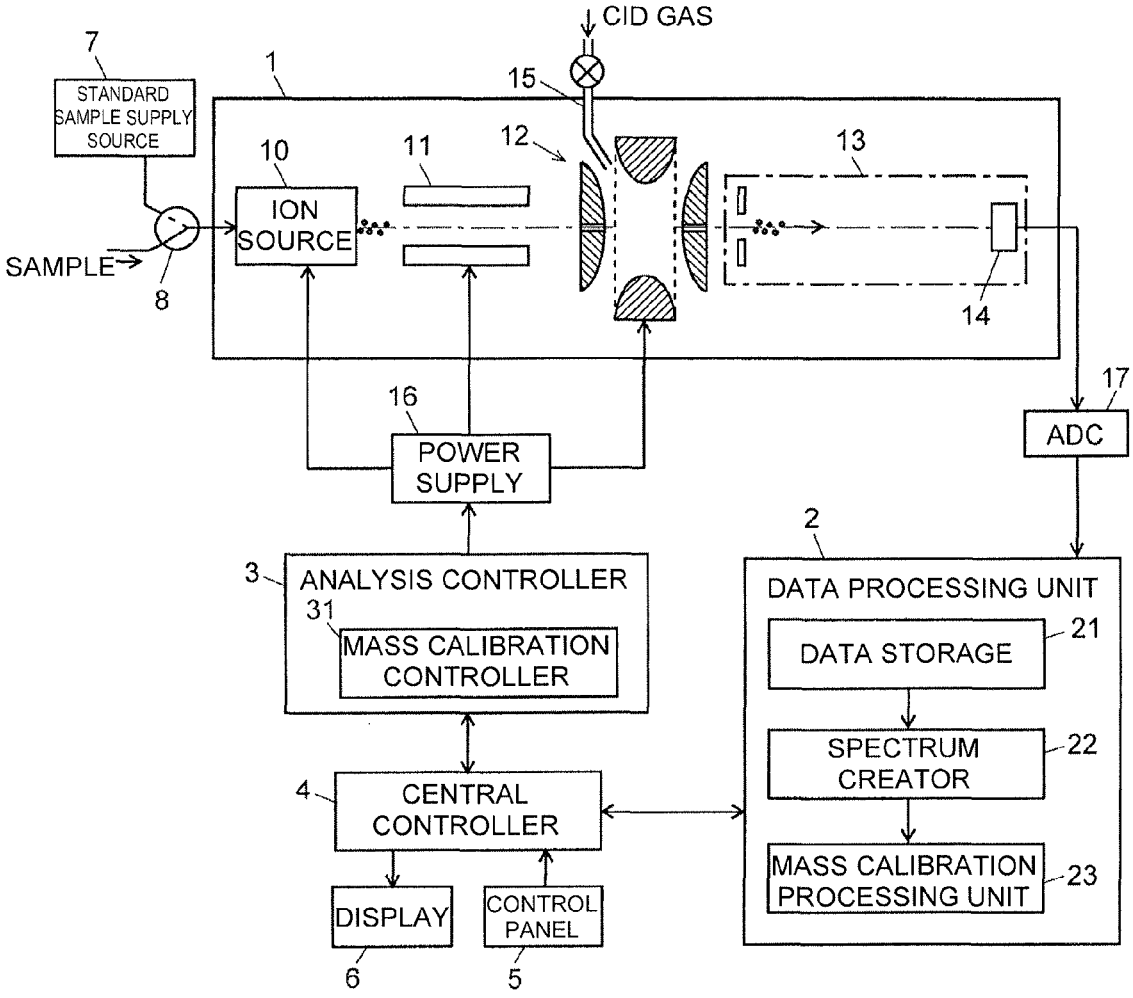
FIG. 4 is a schematic configuration diagram of a mass spectrometer according to a second embodiment.

Next, a mass spectrometer according to a second embodiment of the present invention will be described with reference to FIG. 4. FIG. 4 is a schematic configuration diagram of the mass spectrometer according to the second embodiment. According to the first embodiment described above, the mass-to-charge ratio of the precursor ion needs to be known highly accurately. In contrast, according to the second embodiment, even if the mass-to-charge ratio of the precursor ion is not known accurately, mass calibration can be done using an internal standard method. In FIG. 4, the same components as those of the mass spectrometer shown in FIG. 1 are denoted by the same reference numerals as the corresponding components in FIG. 1, and detailed description thereof will be omitted.

The mass spectrometer according to the second embodiment is equipped with a standard sample supply source 7 and a sample changer 8 and configured to be able to introduce a standard sample containing a known compound (naturally an accurate value of the mass-to-charge ratio is known as well), instead of a test sample to be measured, into the ion source 10. This configuration is based on the assumption that a liquid sample or gaseous sample is supplied to the ion source 10 from outside, but if ion source 10 is a MALDI ion source, it is apparent that a similar function can be achieved by simply changing, as appropriate, a sample to be irradiated with a laser beam.

With the mass spectrometer according to the second embodiment, under the control of a mass calibration controller 31, multiple runs of MS/MS analysis are conducted on a test sample under the same CID conditions that will provide good CID efficiency and spectral data is acquired by each analysis run and stored in the data storage 21. Subsequently, the mass calibration controller 31 introduces the standard sample into the ion source 10 by operating the sample changer 8, performs normal $MS^1$ analysis without involving a CID operation with respect to the standard test sample or MS/MS analysis without performing a CID operation in the ion trap 12 after selecting a precursor ion originating from a known compound in the standard test sample, and thereby acquires spectral data. The analysis on the standard sample may be conducted multiple times rather than only once.

The spectral data obtained from the standard sample always contains information about the peak of an ion whose mass-to-charge ratio is known highly accurately. Consequently, product ions generated from dissociated precursor ions originating from a test sample and the peak of an ion whose mass-to-charge ratio is known highly accurately and which is originated from the standard sample appear in the MS/MS spectrum created by summing up the spectral data. Thus, using the ion peak at which the mass-to-charge ratio is known, the mass calibration processing unit 23 can calibrate other peaks on the MS/MS spectrum, i.e., the mass-to-charge ratios of the product ions originating from the test sample as in the case of the first embodiment.

In mass-calibrating an $MS^n$ spectrum in which n is 3 or above, for example, an $MS^3$ spectrum, using the mass calibration method described in the first embodiment, as a possible method, it is conceivable to adjust CID conditions so as to leave precursor ions whose mass-to-charge ratios are known highly accurately in $MS^2$ in order to use the precursor ions in the $MS^3$ analysis. Although this is theoretically possible, practically it is not necessarily easy to leave precursor ions whose intensity decreases considerably in the first step of CID operation for the next step of the CID operation with sufficient intensity. Furthermore, when the CID operation is repeated it is substantially impossible to use the original precursor ions. Thus, to mass-calibrate an $MS^n$ spectrum in which n is 3 or above, it is advisable to use the mass calibration method described above in the second embodiment, or the mass calibration method described below in the third embodiment.

Third Embodiment

Next, a mass spectrometer according to a third embodiment of the present invention will be described with reference to FIG. 5A, FIG. 5B, FIG. 5C, FIG. 5D, and FIG. 5E. FIG. 5A, FIG. 5B, FIG. 5C, FIG. 5D, and FIG. 5E are spectrum diagrams for explaining a mass calibration technique for an $MS^3$ spectrum on a mass spectrometer according to the third embodiment. Note that basic configuration of the mass spectrometer according to the third embodiment is similar to the first embodiment, slightly differing only in the operation of the mass calibration controller 30 and mass calibration processing unit 23.

Broadly speaking, when mass-calibrating an $MS^n$ spectrum in which n is 3 or above, the mass spectrometer according to the third embodiment regards that the mass-calibrated mass-to-charge ratio at an ion peak in an $MS^{n-1}$ spectrum is a highly accurate value, i.e., a theoretical value, determines the mass deviation from an a theoretical value and actual measured value at the ion peak observed on the $MS^n$ spectrum, and thereby mass-calibrates the $MS^n$ spectrum.

Referring to an example shown in FIG. 5, FIG. 5A, FIG. 5B, and FIG. 5C correspond to the spectra in FIG. 3A, FIG. 3C, and FIG. 3D, and a mass-calibrated MS/MS spectrum such as shown in FIG. 5C is obtained using the mass calibration method described in the first embodiment. As a result of the mass calibration, the mass-to-charge ratio of the product ion which has m/z=303 on an MS/MS spectrum obtained by actual measurement is corrected to 305. Now, by setting the product ion as a precursor ion for $MS^3$ analysis, the $MS^3$ analysis is conducted. Under the control of the mass calibration controller 30, the analyzer 1 carries out the second step of CID operation for the $MS^3$ analysis, in which the excitation energy is lowered in at least one of multiple runs of the MS/MS analysis to such a level that precursor ion remains with sufficient intensity. Although there is a difference between $MS^3$ analysis and MS/MS analysis, the control procedures during the analysis and subsequent data processing procedures are similar to those of the first embodiment shown in FIG. 2.

When an $MS^3$ spectrum such as shown in FIG. 5D is created as a result of the $MS^3$ analysis, the mass calibration processing unit 23 detects a peak corresponding to the precursor ion used in the $MS^3$ analysis, and finds an actual measured value of the mass-to-charge ratio. It is assumed here that the actual measured value is 304. Since the accurate value (the value regarded above as the theoretical value) of the mass-to-charge ratio at the ion peak is 305, the mass deviation $\Delta M$ is 1 Da, and the $MS^3$ spectrum shown in FIG. 5E is created by shifting the $MS^3$ spectrum toward the higher side of the mass-to-charge ratio by the mass deviation.

It is apparent that an $MS^n$ spectrum in which n is 4 or above can be mass-calibrated by repeating the method described above. Although this mass calibration method is not an internal standard method in a strict sense, since mass calibration is performed using information mass-calibrated based on the results of an $MS^n$ analysis conducted at a time closest to the $MS^n$ analysis conducted to obtain a desired $MS^n$ spectrum, the mass calibration can be performed with accuracy close to that of an internal standard method.

Note that all the embodiments described above are merely examples of the present invention, and thus, it is apparent that any modification, change, or addition made as appropriate within the spirit and scope of the present invention is also included in the scope of the appended claims.

REFERENCE SIGNS LIST

1 . . . Analyzer
10 . . . Ion Source
11 . . . Ion Transport Optical System
12 . . . Ion trap
13 . . . Time-of-Flight Mass Spectrograph (TOF)
14 . . . Ion Detector
15 . . . Gas Supply Pipe
16 . . . Power Supply
17 . . . Analog-to-Digital Converter (ADC)
2 . . . Data Processing Unit
21 . . . Data Storage
22 . . . Spectrum Creator
23 . . . Mass Calibration Processing Unit
3 . . . Analysis Controller
30, 31 . . . Mass Calibration Controller
4 . . . Central Controller
5 . . . Control Panel
6 . . . Display
7 . . . Standard Sample Supply Source
8 . . . Sample Changer

The invention claimed is:

1. A mass spectrometer provided with an ion dissociator for dissociating ions originating from a compound in a sample and a mass analyzer for performing mass analysis on ions generated by an ion dissociation operation of the ion dissociator and configured to be able to perform $MS^n$ (where n is an integer equal to or larger than 2) analysis, the mass spectrometer comprising:

a) an analysis controller for causing the ion dissociator to perform a dissociation operation with a dissociation condition adjusted such that a peak corresponding to a known mass-to-charge ratio and observed in an $MS^1$ spectrum obtained without performing an ion dissociation operation remains in an $MS^n$ spectrum;

b) a spectrum creator for creating the $MS^n$ spectrum based on spectral data obtained when the dissociation operation is performed by the ion dissociator under control of the analysis controller; and c) a mass calibration processing unit for detecting the peak corresponding to the known mass-to-charge ratio in the $MS^n$ spectrum created by the spectrum creator and calibrating mass-to-charge ratios at respective peaks in the $MS^n$ spectrum using a difference between an actual measured value and a known value of the mass-to-charge ratio at the peak, wherein the peak corresponding to the known mass-to-charge ratio is a peak of a precursor ion for $MS^n$ analysis or a peak of an isotopic ion which has a same composition of elements as the precursor ion and contains an element other than a stable isotope.

2. The mass spectrometer according to claim 1, wherein:

the spectrum creator creates the $MS^n$ spectrum by summing up spectral data obtained through a plurality of $MS^n$ analysis runs; and in at least one of a plurality of $MS^n$ analysis runs on a same sample, the analysis controller performs a mass analysis without dissociating a precursor ion or performs a mass analysis involving a dissociation operation in which the dissociating energy given to a precursor ion is lowered to such a level that the precursor ion is assumed to remain adequately in the $MS^n$ spectrum.

3. A mass spectrometer provided with an ion dissociator for dissociating ions originating from a compound in a sample into n−1 steps and a mass analyzer for performing mass analysis on ions generated by an ion dissociation operation of the ion dissociator and configured to be able to perform $MS^n$ (where n is an integer equal to or larger than 3) analysis, the mass spectrometer comprising:

a) an analysis controller for causing the ion dissociator to perform a dissociation operation with a dissociation condition adjusted such that a precursor ion for the (m−1)th step of the dissociation operation remains in an $MS^m$ spectrum during an $MS^m$ analysis (where m is 2, 3, . . . , n);

b) a spectrum creator for creating an $MS^m$ spectrum based on spectral data obtained when the dissociation operation is performed by the ion dissociator under control of the analysis controller; and c) a mass calibration processing unit for detecting a peak of a precursor ion having a known mass-to-charge ratio in an $MS^2$ spectrum created by the spectrum creator and calibrating mass-to-charge ratios at respective peaks in the $MS^2$ spectrum using a difference between an actual measured value and a known value of the mass-to-charge ratio at the peak when m is 2 or detecting a peak of a precursor ion or a product ion whose mass-to-charge ratio has been calibrated, in an $MS^m$ spectrum created by the spectrum creator and calibrating mass-to-charge ratios at respective peaks in the $MS^m$ spectrum using a difference between an actual measured value of the mass-to-charge ratio at the peak and a calibrated value of the mass-to-charge ratio when m is between 3 and n−1 both inclusive.

4. A mass calibration method for a mass spectrometer adapted to dissociate ions originating from a compound in a sample and analyze ions generated by an ion dissociation operation and configured to be able to perform $MS^n$ (where n is an integer equal to or larger than 2) analysis for performing mass analysis on ions, the mass calibration method comprising:

a spectrum creation step of performing a dissociation operation with a dissociation condition adjusted such that a peak corresponding to a known mass-to-charge ratio and observed in an $MS^1$ spectrum obtained without performing an ion dissociation operation remains in an $MS_n$ spectrum and creating the $MS^n$ spectrum based on spectral data thus obtained;

a mass calibration step of detecting the peak corresponding to the known mass-to-charge ratio in the $MS^n$ spectrum created in the spectrum creation step and calibrating mass-to-charge ratios at respective peaks in the $MS^n$ spectrum using a difference between an actual measured value and a known value of the mass-to-charge ratio at the peak wherein the peak corresponding to the known mass-to-charge ratio is a peak of a precursor ion for $MS^n$ analysis or a peak of an isotopic ion which has a same composition of elements as the precursor ion and contains an element other than a stable isotope.

* * * * *